US006324789B1

(12) United States Patent
Stephen

(10) Patent No.: US 6,324,789 B1
(45) Date of Patent: Dec. 4, 2001

(54) ENCASED OVERHEAD DOOR OPERATOR HAVING THREADABLY ATTACHED MOUNTS

(75) Inventor: Erich P. Stephen, Roxboro (CA)

(73) Assignee: Westinghouse Air Brake Company, Wilmerding, PA (US)

( * ) Notice: Subject to any disclaimer, the term of this patent is extended or adjusted under 35 U.S.C. 154(b) by 0 days.

(21) Appl. No.: 09/466,026

(22) Filed: Dec. 17, 1999

(51) Int. Cl.[7] ..... E05F 11/34; E05F 11/00; E05D 15/06

(52) U.S. Cl. ..... 49/362; 49/360; 49/409; 49/118

(58) Field of Search ..... 49/362, 360, 409, 49/116, 118; 403/345, 343, 299, 300, 302

(56) References Cited

U.S. PATENT DOCUMENTS

| | | | | |
|---|---|---|---|---|
| 931,247 | * | 8/1909 | Armstrong | 49/116 |
| 1,334,306 | * | 3/1920 | Liberty | 285/18 |
| 1,411,039 | * | 3/1922 | Lacey | 49/118 |
| 2,056,174 | * | 10/1936 | Earhuff et al. | 318/266 |
| 2,951,390 | * | 9/1960 | Martens et al. | 74/424.8 R |
| 3,204,170 | * | 8/1965 | Monks | 318/267 |
| 3,745,705 | * | 7/1973 | Reddy | 49/139 |
| 3,996,697 | * | 12/1976 | Bailey et al. | 49/28 |
| 4,370,826 | * | 2/1983 | Davidson | 49/63 |
| 4,459,060 | * | 7/1984 | Patterson | 403/2 |
| 4,605,180 | * | 8/1986 | Monot | 477/8 |
| 4,655,630 | * | 4/1987 | Rinehart | 403/342 |
| 4,819,743 | * | 4/1989 | Rousselot et al. | 74/89.15 |
| 4,821,456 | * | 4/1989 | Nogaki | 49/362 |
| 5,077,938 | * | 1/1992 | Moreuil | 49/362 |
| 5,341,598 | * | 8/1994 | Reddy | 49/362 |
| 5,460,459 | * | 10/1995 | Morgan | 403/350 |
| 5,664,372 | * | 9/1997 | Williams et al. | 49/362 |
| 5,787,644 | * | 8/1998 | Thomsen | 49/351 |
| 6,004,083 | * | 12/1999 | Huggins et al. | 409/232 |
| 6,134,838 | * | 10/2000 | Reddy | 49/362 |

* cited by examiner

*Primary Examiner*—Gregory J. Strimbu
(74) *Attorney, Agent, or Firm*—James Ray & Associates

(57) ABSTRACT

A door support and drive mechanism for a door can be mounted either over or in a door opening in a transit vehicle or other structure. The mechanism includes a tube which has a longitudinal slot. The mechanism also has mounts attached to the tube for mounting the mechanism to the structure over the door opening, so that the tube is substantially horizontal and the slot is along a lower portion of the tube. The mechanism includes at least one door hanger which has an upper portion movably disposed within the tube and a depending portion passing through the slot, the depending portion being for attachment to the door. The mechanism has a drive nut attached to the door hanger. A drive screw is positioned in the tube, engaging a threaded inner portion of the drive nut. The drive screw is connectable to a rotary power device to be rotated thereby. Rotation of the drive screw causes longitudinal movement of the drive nut and the hanger to which the drive nut is attached, so that the door is moved longitudinally.

17 Claims, 9 Drawing Sheets

FIG. 3A
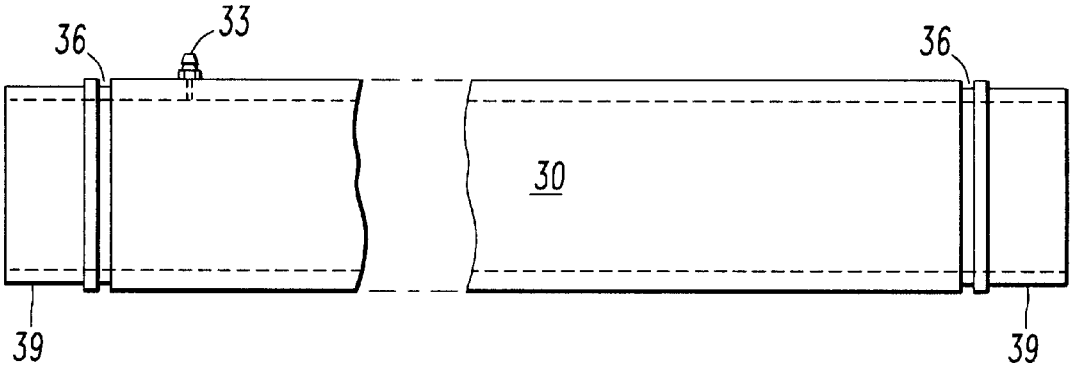
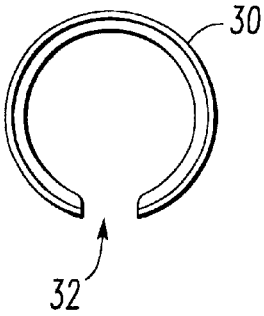
FIG. 3B

FIG. 8A
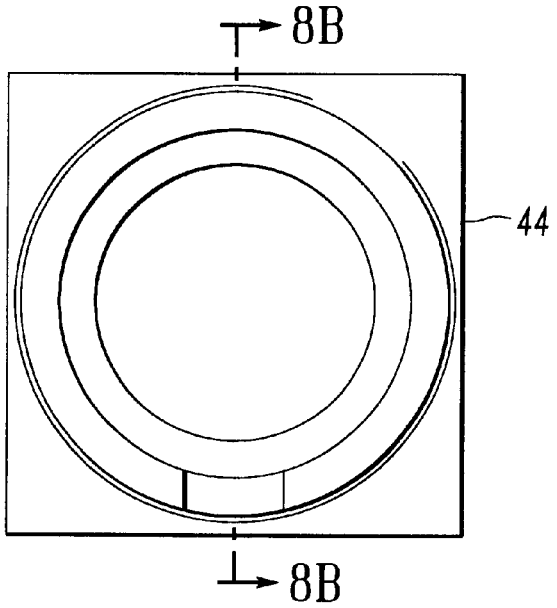
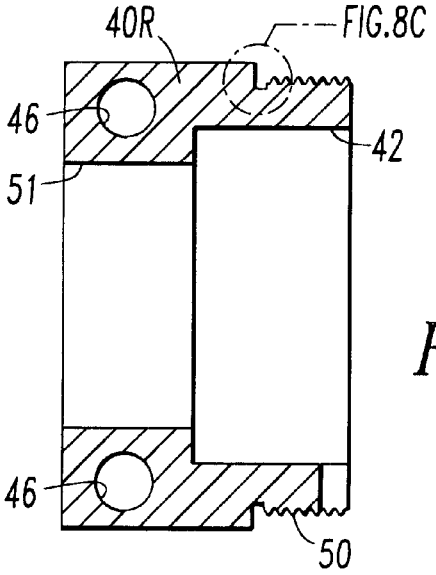
FIG. 8B
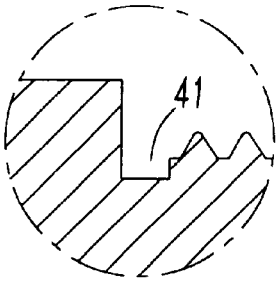
FIG. 8C

FIG. 9A
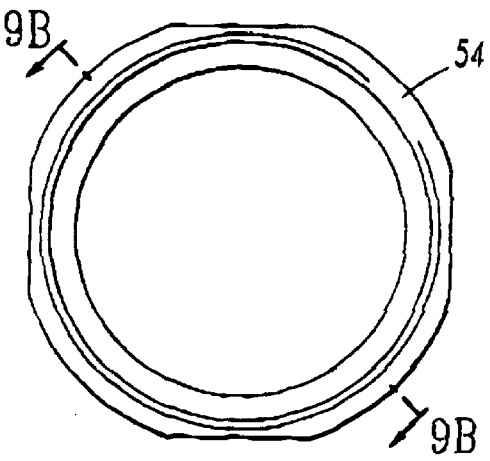
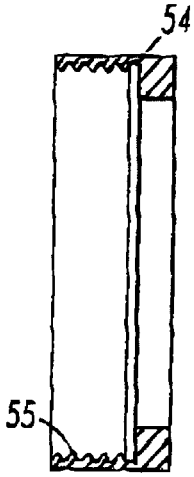
FIG. 9B
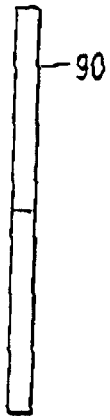
FIG. 10A
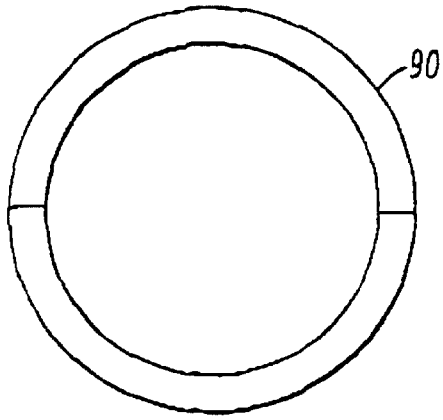
FIG. 10B
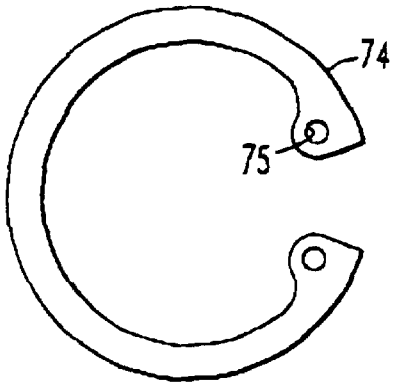
FIG. 11

ENCASED OVERHEAD DOOR OPERATOR HAVING THREADABLY ATTACHED MOUNTS

CROSS-REFERENCE TO RELATED APPLICATIONS

The invention described in this patent application is closely related to the following copending patent applications: TRANSIT VEHICLE DOOR, Ser. No. 09/099,260, filed on Jun. 18, 1998, which issued as U.S. Pat. No. 6,032,416 on Mar. 7, 2000. It is also related to the patent application: DOOR DRIVE AND LOCK FOR A MASS TRANSIT VEHICLE, Ser. No. 08/804,779, filed on Feb. 24, 1997, which issued as U.S. Pat. No. 6,134,838 on Oct. 24, 2000.

FIELD OF THE INVENTION

The present invention relates, in general, to motorized sliding doors and, more particularly, the instant invention relates to a suspension and drive mechanism for transit vehicle doors.

BACKGROUND OF THE INVENTION

Overhead sliding door operators presently on the market consist of two basic systems.

(1) They have a load bearing system which supports the weight of the door panel or panels and allows movement of the door. This is normally accomplished by using a precision shaft and linear bearings, or rollers, supported in a C-shaped, bent or extruded, member. Doors are generally supported by door hangers which are free to move along horizontal rods or tracks.

(2) Door operators also have mechanisms for moving the doors. A belt and pulley system, for example, may be used to move the doors. Alternatively, overhead door operators may employ a helical drive member which engages a drive nut attached to a door hanger. A motor is used to rotate the helical drive and this causes movement of the nut along the drive.

These two systems are normally placed parallel to each other, necessitating a linkage between the two systems. For a system employing a helical drive member, the linkage connects the drive nut to the door hanger. This linkage presents design problems because it must transmit a drive force to the door panel and it must accommodate misalignment between the two systems.

Systems presently on the market are also open to dust, dirt, metal chips etc, causing contamination of the screw mechanism and/or of the linear bearings.

In many systems, a 1" diameter precision shaft is used to support the door panels. This limits the available span between supports. Generally, full linear bearings are preferred over split bearings.

For application to a transit vehicle, the two systems may be separately attached to the vehicle or the system may include a base to which the two systems are attached. The base is attached to the vehicle.

SUMMARY OF THE INVENTION

In one aspect, the invention is an apparatus for supporting and driving a door mounted either over or in a door opening in a transit vehicle or other structure. The apparatus includes a tube which has a longitudinal slot and a mounting means attached to the tube for mounting it to the structure over the door opening in a position such that the tube is substantially horizontal and the slot is positioned along a lower portion of the tube. The apparatus further includes at least one door hanger which has an upper portion movably disposed within the tube and a depending portion passing through the slot for attachment of the door. A drive nut is attached to the door hanger and a drive screw is positioned in the tube and engages a threaded inner portion of the drive nut. The drive screw is connectable to a rotary power means to be rotated thereby. Rotation of the drive screw causes longitudinal movement of the drive nut and the hanger to which the drive nut is attached, so that the door is moved longitudinally.

In another aspect, the invention is an apparatus for supporting and driving a door mounted over or in a door opening in a transit vehicle or other structure. The apparatus supports and moves the door. It includes a tube which has a longitudinal slot and mounting means attached to the tube for mounting it to the structure over the door opening in a position such that the tube is substantially horizontal and the slot is along a lower portion of the tube. The apparatus includes two door hangers. Each of the door hangers has an upper portion movably disposed within the tube and a depending portion passing through the slot. The depending portions are for attachment of the door. A drive nut is attached to one of the door hangers and a drive screw is positioned in the tube in a position to engage a threaded inner portion of the drive nut. The drive screw is connectable to a rotary power means to be rotated thereby. Rotation of the drive screw causes longitudinal movement of the drive nut and the hanger to which the drive nut is attached, so that the door is moved longitudinally.

In a further aspect, the present invention is an apparatus for supporting and moving a door mounted either over or in a door opening in a transit vehicle or other structure. It includes a tube which has a longitudinal slot and a mounting means attached to the tube for mounting it to the structure over the door opening in a position such that the tube is substantially horizontal and the slot is along a lower portion of the tube. There is at least one door hanger having an upper portion movably disposed within the tube and a depending portion passing through the slot. The depending portion is for attachment of the door. The apparatus includes a drive nut attached to the door hanger and a drive screw positioned in the tube engaging a threaded inner portion of the drive nut. The drive screw is connected to a rotary power means to be rotated thereby. Rotation of the drive screw causes longitudinal movement of the drive nut and the hanger to which the drive nut is attached, so that the door is moved longitudinally.

OBJECTS OF THE INVENTION

It is therefore one of the primary objects of the present invention to provide a modular door suspension and drive mechanism for supporting and driving a sliding door.

Another object of the present invention is to provide a modular door suspension and drive mechanism which is compact and light weight.

Still another object of the present invention is to provide a motorized door drive in which the motor, door suspension and drive connection are all incorporated into a single module.

Yet another object of the present invention is to provide a motorized door drive for a door that covers and uncovers a door opening which requires a minimal number of attachments to structures adjacent the door opening.

A further object of the present invention is to provide a motorized door drive for a door that covers and uncovers a door opening which requires a minimum number of fasteners to attach it to structures adjacent the door opening.

It is an additional object of the present invention to provide a motorized door drive for a transit vehicle door which requires attachment only at its ends so that load induced camber of the vehicle does not affect the door drive.

Still yet another object of the present invention is to provide a motorized door drive having mounts which may be rotated to facilitate engagement with structures adjacent the door opening.

Yet still another object of the present invention is to provide a door drive having a drive mechanism which is protected from environmental elements.

A still further object of the present invention is to provide a door drive having a drive mechanism which is protected from dust, dirt and metal chips.

Still another object of the present invention is to provide a concentric configuration for a door drive and hanger.

In addition to the various objects and advantages of the present invention which have been generally described above, there will be various other objects and advantages of the invention that will become more readily apparent to those persons who are skilled in the relevant art from the following more detailed description of the invention, particularly, when the detailed description is taken in conjunction with the attached drawing figures and with the appended claims.

BRIEF DESCRIPTION OF THE DRAWINGS

FIG. 3A is a side view of the slotted tube of the invention.

FIG. 3B is an end view of the slotted tube shown in FIG. 3A.

FIG. 8A is an end view of the mount at the end remote from the motor.

FIG. 8B is a sectional view of the mount at the end remote from the motor cut along line 8B—8B of FIG. 8A.

FIG. 8C is a detail view showing clearance at the end of the external threaded portion of the mount.

FIG. 9A is an end view of one of the nuts which secure tube to the mounts.

FIG. 9B is a longitudinal cross sectional view of one of the nuts which secure the tube to the mounts, cut along line 9B—9B of FIG. 9A.

FIG. 10A is an end view of one of the split rings used to secure the tube to the mounts.

FIG. 10B is a side view of one of the split rings used to secure the tube to the mounts.

FIG. 11 is an axial view of one of the snap rings used to secure the drive nut to the drive hanger.

Figure 1:
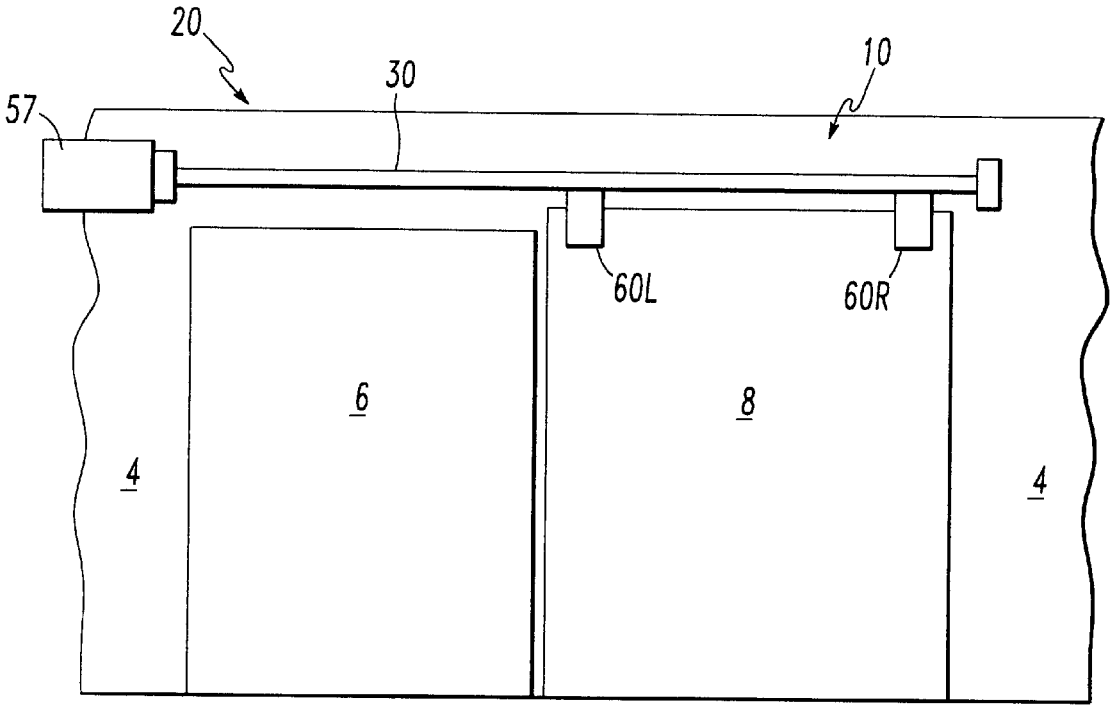
FIG. 1 is a side elevation view of the invention used to open and close a sliding door.

BRIEF DESCRIPTION OF THE PRESENTLY PREFERRED AND VARIOUS ALTERNATIVE EMBODIMENTS OF THE INVENTION

Prior to proceeding to the much more detailed description of the present invention, it should be noted that identical components which have identical functions have been identified with identical reference numerals throughout the several views illustrated in the drawing figures for the sake of clarity and understanding of the invention.

Attention is now directed to FIG. 1 which shows a door operator, generally designated 20, that is mounted overhead of a door opening 6 in a structure 4. The invention is particularly directed to an application in which structure 4 is a transit vehicle. Operator 20 moves door 8 over and away from door opening 6. Door operator 20 includes a door support and drive mechanism, generally designated 10, which is connected to a rotary power unit 57.

Figure 2B:
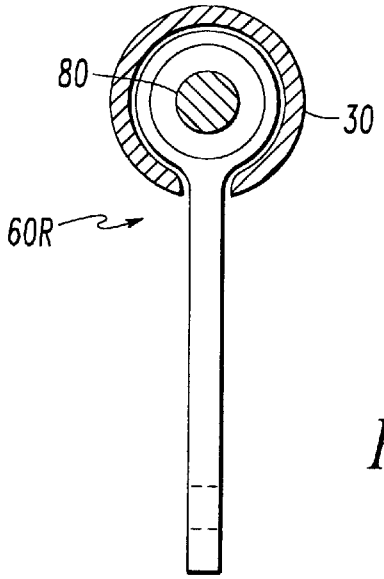
FIG. 2B is a cross-sectional view of the invention taken along the line 2B—2B in FIG. 2A.
Figure 2A:
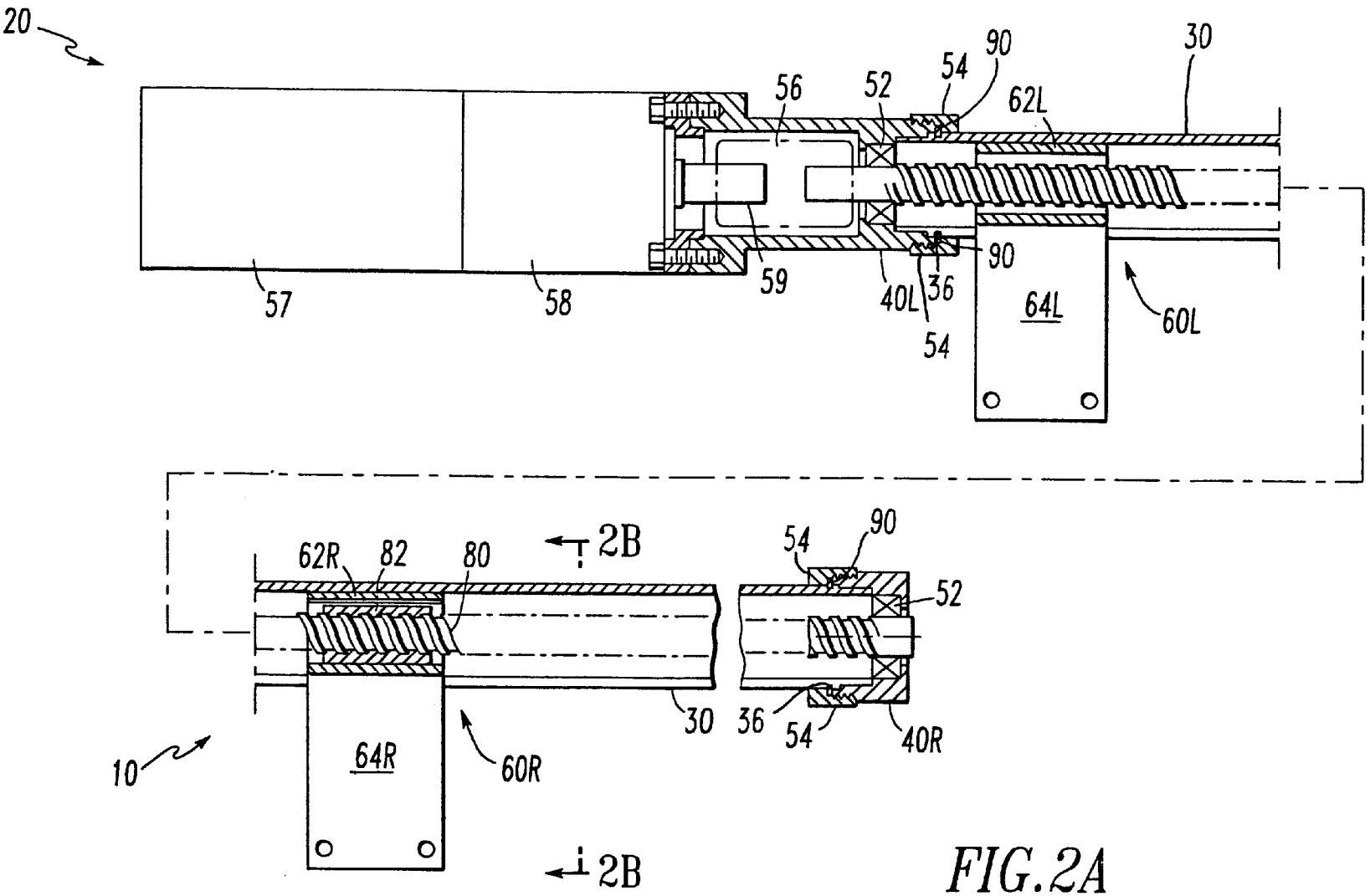
FIG. 2A is a side view, partially in cross section of the presently preferred embodiment of the invention.

As will become clear from referring to FIGS. 2A and 2B, the door 8 is suspended from a slotted tube 30 attached to structure 4 by mounts 40L and 40R which, preferably, are located at its ends.

In this application, the term "tube" is intended to mean an elongate member having an internal cavity substantially along the length of the member.

The tube is mounted substantially horizontally above door opening 6. Slotted tube 30, shown in greater detail in FIGS. 3A and 3B, is preferably round. Door 8 is attached to at least one hanger 6OR which has an upper portion 62R slidably disposed within slotted tube 30 so as to be supported by tube 30. Hanger 60R has a depending portion 64R which passes through slot 32 in tube 30. Door 8 is attached to the depending portion 64R. Hanger 60R is attached to a drive nut 82 which is moved by drive screw 80. Drive screw 80 is coupled, as described below, to rotary power unit 57.

In the presently preferred embodiment, there are two hangers 60L and 60R. Like hanger 60R, hanger 60L has an upper portion 62L slidably disposed within slotted tube 30 and a depending portion 64L which passes through slot 32 in tube 30. Door 8 is also attached to depending portion 64L of hanger 60L.

The rotary power unit 57 preferably includes a motor and a planetary gear reduction unit (not separately shown). The unit 57 has a stationary portion 58 and an output power rotor 59. It is preferred that a coupler 56 connect the output power rotor 59 to drive screw 80.

FIG. 3A shows cylindrical end portions 39 on tube 30 which are preferably included for attachment of mounts 40L and 40R. Cylindrical end portions 39 enable mounts 40L and 40R to be attached to a portion of structure 4 in any orientation. FIG. 3A also shows circumferential grooves 36 which are preferably included at each end of tube 30. Circumferential grooves 36 are for retaining rings 90 (FIGS. 10A and 10B) used for attaching mounts 40L and 40R to tube 30. A lubrication fitting 33 is preferably attached to tube 30 near one end, as shown. Lubrication is supplied to tube 30 to facilitate sliding of hangers 60L and 60R. Preferably, the inside of tube 30 is coated with a hard metallic coating. Such coating may be, for example, electroless nickel. It is preferred that the inner surface of tube 30 be polished.

Figure 4A:
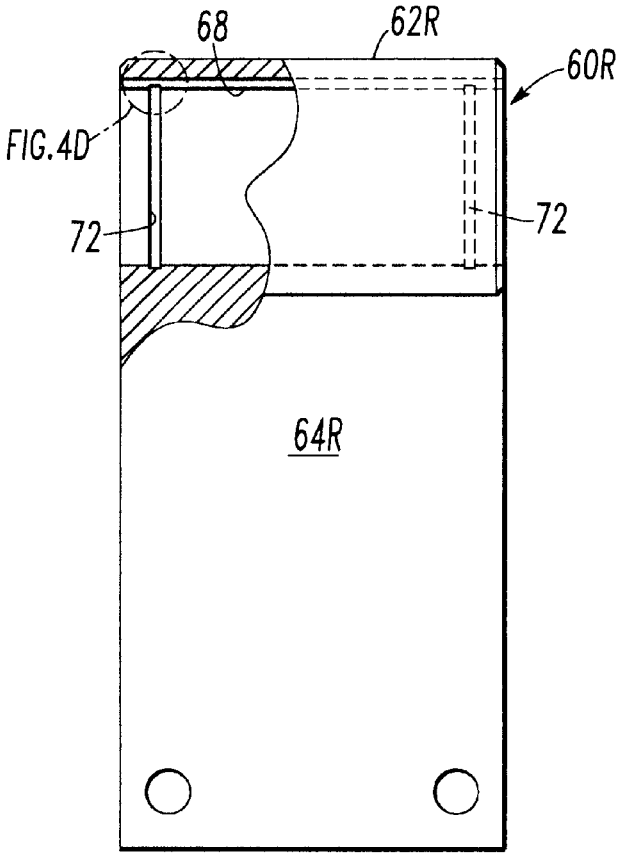
FIG. 4A is a side view, partially in cross section, of the drive hanger.
Figure 4B:
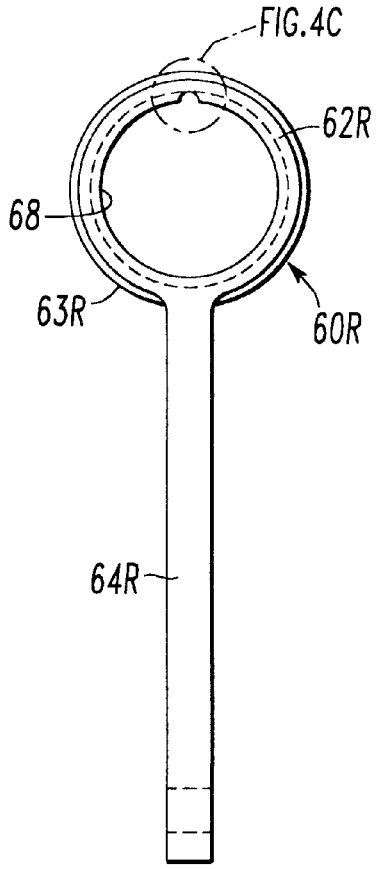
FIG. 4B is an end view of the drive hanger.
Figure 4C:
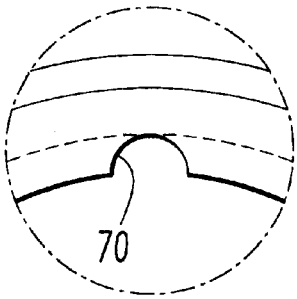
FIG. 4C is a detail view of a longitudinal anti-rotation groove in the drive hanger.
Figure 4D:
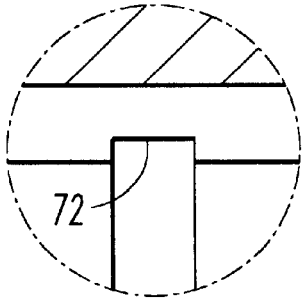
FIG. 4D is a detail view of a circumferential groove for a retaining ring in the drive hanger.

Details of hanger 60R are shown in FIGS. 4A and FIG. 4B. Hanger 60R has upper portion 62R which has a cylindrical outer surface portion 63R for sliding within tube 30. It has depending portion 64R to which door 8 is attached. Hanger 60R preferably has a bore 68 to accommodate drive nut 82. It is preferred that circumferential grooves 72 (best seen in FIGS. 4A and 4D) be formed within bore 68 to accommodate retaining rings to secure drive nut 82 within bore 68. It is also preferred that a longitudinal groove 70 (best seen in FIG. 4C) be formed in bore 68 for keying of drive nut 82 to prevent rotation thereof.

Figure 5A:
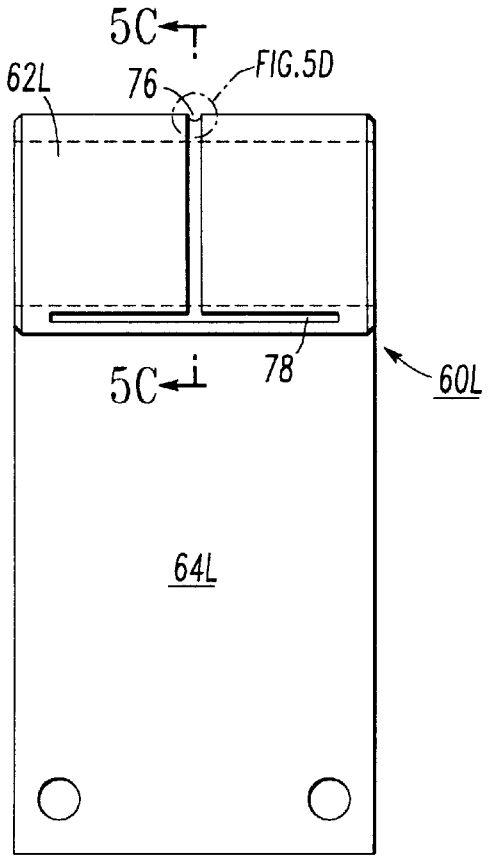
FIG. 5A is a side view of a hanger having lubrication grooves.
Figure 5B:
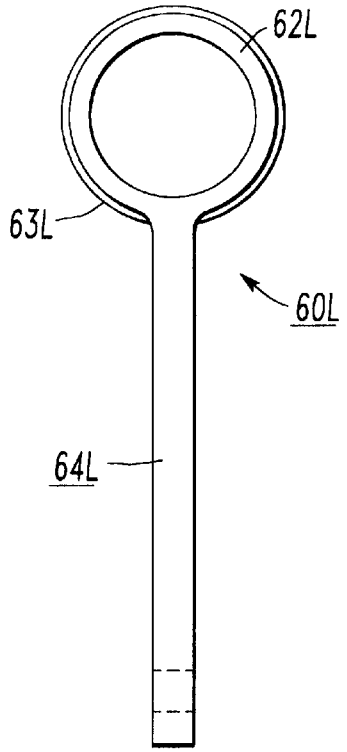
FIG. 5B is an end view of the hanger which has lubrication grooves.
Figure 5C:
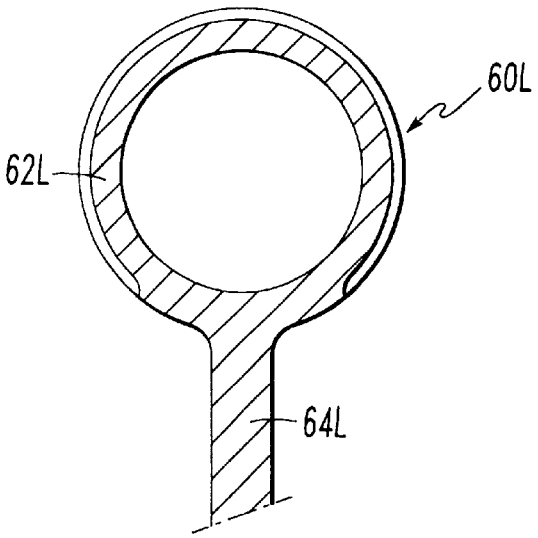
FIG. 5C is a cross-sectional view of the hanger which has lubrication grooves, cut along line 5C—5C of FIG. 5A.
Figure 5D:
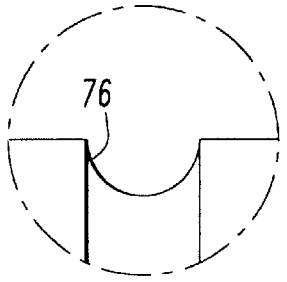
FIG. 5D is an enlarged view of the circumferential lubrication groove shown encircled in FIG. 5A.

Details of hanger 60L are provided by FIGS. 5A, 5B and 5C. Hanger 60L has upper portion 62L which has a cylindrical outer surface portion 63L for sliding within tube 30. Hanger 60L has depending portion 64L to which door 8 is attached. It is preferred that hanger 60L have a circumferential lubrication groove 76 communicating with a longitudinal lubrication groove 78. To supply lubricant, door 8 is preferably placed in either the fully open or the fully closed position, so that circumferential lubrication groove 76 is directly underneath lubrication fitting 33 in tube 30. For this reason, lubrication fitting 33 is preferably located near one end of tube 30.

It is preferred that cylindrical outer surface portion 63L of hanger 60L and cylindrical outer surface portion 63R of hanger 60R have a hard coating. Such coating may be, for example, a ceramic coating.

Figure 6A:
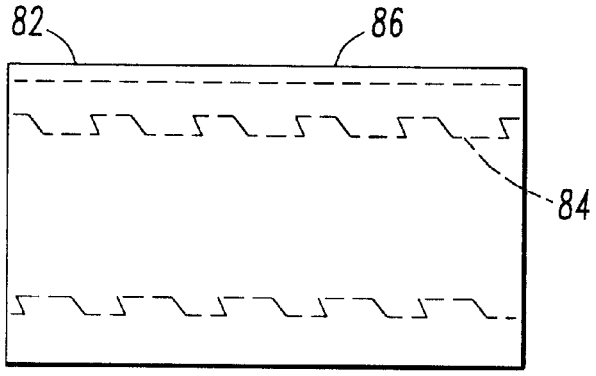
FIG. 6A is a longitudinal view of the drive nut.
Figure 6B:
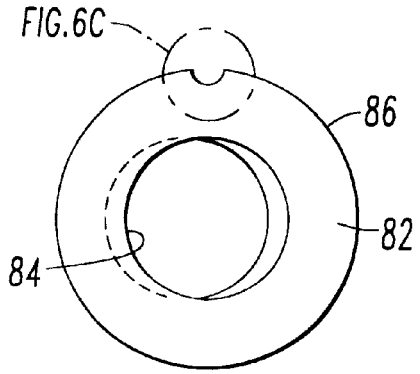
FIG. 6B is an end view of the drive nut.
Figure 6C:
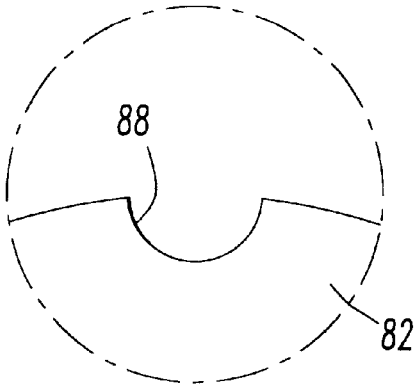
FIG. 6C is a detail of the longitudinal anti-rotation groove in the drive nut.
Figure 6D:
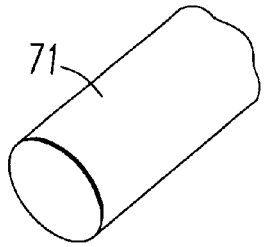
FIG. 6D is an end view of the anti-rotation key for the drive nut.

Details of drive nut 82 are shown in FIGS. 6A, 6B and 6C. FIG. 6A, which illustrates the longitudinal view of drive nut 82, shows threaded inner portion 84, which engages drive screw 80 to be moved thereby. Preferably, drive nut 82 has a cylindrical outer surface portion 86 to fit within drive nut engaging bore 68 of hanger 60R. Drive nut 82 has a longitudinal groove 88 which receives a key 71, shown in FIG. 6D. Key 71 also engages longitudinal groove 70 of hanger 60R to prevent rotation of drive nut 82.

Figure 6E:
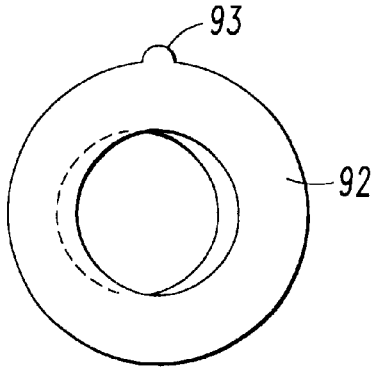
FIG. 6E is an end view of an alternate drive nut which has a longitudinal anti-rotation ridge.

FIG. 6E shows an alternate drive nut 92 which has a longitudinal ridge 93 to fit within longitudinal groove 70 of hanger 60R to prevent rotation of drive nut 92. Drive nut 92 does not require a key. The presently preferred drive screw 80 is coated with a low friction fluorocarbon such as Teflon and the drive nut 82 is made of a low friction plastic.

Figure 7A:
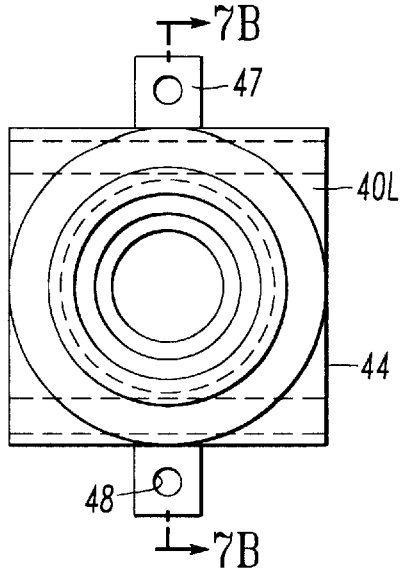
FIG. 7A is an end view of the mount at the motor end.
Figure 7B:
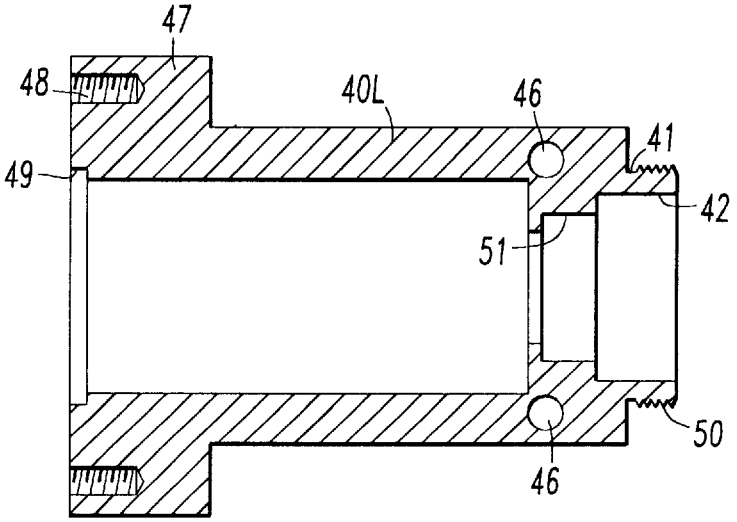
FIG. 7B is a longitudinal cross-sectional view of the mount at the motor end, along the lines 7B—7B in FIG. 7A.
Figure 7C:
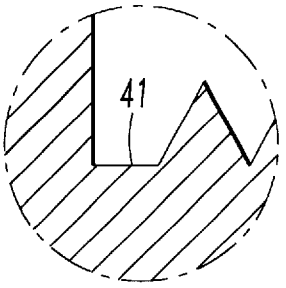
FIG. 7C is a detail view showing clearance at the end of the external threaded portion of the mount.

FIGS. 7A, 7B and 7C provide detail of the mount 40L to which tube 30 and rotary power unit 57 are attached. Mount 40L preferably has fastener holes 46 to accommodate fasteners, such as bolts, and a flat surface portion 44 for engagement with structure 4. Mount 40L has a tube engaging bore 42 for engagement with cylindrical end portion 39 of tube 30. Mount 40L has a threaded exterior surface portion 50 for attachment to tube 30, as discussed below. Threaded exterior surface portion 50 has a clearance 41, as shown in FIG. 7C. Mount 40L preferably has motor attachment lugs 47 for attachment of rotary power unit 57. Motor attachment lugs 47 have fastener holes 48 for attachment of rotary power unit 57 and it preferably has a motor receiving socket 49 for engaging rotary power unit 57.

FIGS. 8A, 8B and 8C provide detail of the mount 40R which is at the end of operator 20 which is remote from rotary power unit 57. Mount 40R has a threaded exterior surface portion 50 for attachment to tube 30, as discussed below. Clearance 41 is preferably provided for threaded exterior surface portion 50. Mount 4OR has tube engaging bore 42 to engage cylindrical end portion 39 of tube 30. Preferably, it has fastener holes 46 to accommodate fasteners, such as bolts, to attach mount 40R to structure 4. Preferably, mount 40R has a flat surface portion 44 to engage structure 4.

Preferably, mounts 40L and 40R each have a socket 51 for a rotary bearing 52 for drive screw 80. Each of the mounts, 40L and 40R are attached to tube 30 by a retaining nut 54. Details of nut 54 are provided in FIG. 9A and FIG. 9B. Nut 54 has threaded inside surface portion 55 for engaging threaded exterior surface portion 50 of mounts 40L and 40R. It is preferred that drive screw 80 be mounted concentrically within tube 30.

A retaining ring 90, preferably a split ring, is shown in FIGS. 10A and 10B. Retaining ring 90 fits in circumferential groove 36 at each end of tube 30 to engage retaining nuts 54 and mounts 40L and 40R to attach mounts 40L and 40R to tube 30. A retaining ring 90 disposed within a respective groove 36 is captured between a retaining nut 54 and mount 40L to attach mount 40L to tube 30. Likewise, a retaining ring 90 disposed within a respective groove 36 is captured between a retaining nut 54 and mount 40R to attach mount 40R to tube 30. This arrangement is best seen in FIG. 2A.

FIG. 11 shows a retaining ring 74 which is used to prevent axial movement of drive nut 82 in nut engaging bore 68 of hanger 60R. Preferably, retaining ring 74 is a snap ring having holes 75 at its ends for a snap ring insertion tool.

While a presently preferred and various additional alternative embodiments of the instant invention have been described in detail above in accordance the patent statutes, it should be recognized that various other modifications and adaptations of the invention may be made by those persons who are skilled in the relevant art without departing from either the spirit of the invention or the scope of the appended claims.

I claim:

1. An apparatus for supporting and moving a door at least one of over and in a door opening in a structure, said apparatus comprising:

(a) a tube having a longitudinal slot, a first end having a circumferential groove on an outer surface thereof and a second end having a circumferential groove on an outer surface thereof;

(b) a first mount for said first end of said tube and a second mount for said second end of said tube, said first and said second mounts for mounting said tube to said structure above said door opening so that said tube is substantially horizontal with said longitudinal slot disposed along a lower portion of said tube, said first and said second mounts each having (I) a threaded exterior surface portion and (II) a tube engaging bore with which to engage said first and said second ends, respectively, of said tube;

(c) first and second retaining rings each of which disposed in a respective one of said circumferential grooves;

(d) first and second retaining nuts for threading onto said threaded exterior surface portions of said mounts, said first retaining nut securing said first retaining ring between said first mount and said first retaining nut and thus attaching said tube at said first end thereof to said first mount, said second retaining nut securing said second retaining ring between said second mount and said second retaining nut and thus attaching said tube at said second end thereof to said second mount, (e) first and second door hangers each of which having (I) an upper portion movably disposed within said tube and (II) a depending portion suspended from said upper portion through said longitudinal slot, said depending portions adapted to be attached to said door;

(f) a drive nut fixed to said upper portion of said second door hanger, said drive nut having a threaded inner surface; and (g) a drive screw disposed within said tube, said drive screw connectable to a rotary power unit to be rotated thereby, said drive screw engaging said threaded inner surface of said drive nut whereby rotation of said drive screw causes longitudinal movement of said drive nut along said drive screw.

2. An apparatus, according to claim 1, wherein at least one of said first mount and said second mount has a substantially flat surface for engaging said structure and at least one mounting hole substantially normal to said substantially flat surface, said mounting hole to accommodate a fastener.

3. An apparatus, according to claim 1, wherein said tube engaging bore of at least one of said first mount and said second mount has a cylindrical surface portion for attaching said at least of said first mount and said second mount to said tube in a range of angular orientations relative to said tube to facilitate attachment to said structure.

4. An apparatus, according to claim 1, wherein each of said retaining rings is a split ring.

5. An apparatus, according to claim 1, wherein at least one of said first mount and said second mount includes a rotary bearing for said drive screw.

6. An apparatus, according to claim 1, wherein said drive screw is concentric with said tube.

7. An apparatus, according to claim 1, wherein said upper portion of said second door hanger to which said drive nut is attached has a nut engaging bore for receiving a cylindrical outer surface of said drive nut.

8. An apparatus, according to claim 7, wherein said nut engaging bore of said upper portion of said second door hanger has a longitudinal groove for receiving one of a key and a longitudinal protuberance of said drive nut to prevent rotation of said drive nut within said nut engaging bore.

9. An apparatus, according to claim 7, wherein said nut engaging bore of said upper portion of said second door hanger has a pair of circumferential grooves in each of which a retaining ring is disposed to prevent axial movement of said drive nut relative to said second door hanger to which said drive nut is fixed.

10. An apparatus, according to claim 9, wherein said retaining rings for said circumferential grooves of said nut engaging bore are snap rings.

11. An apparatus, according to claim 1, wherein said tube has a polished bore.

12. An apparatus, according to claim 11, wherein said upper portion s of said first and said second door hangers each have a cylindrical outer surface portion for engaging said polished bore of said tube.

13. An apparatus, according to claim 12, wherein said cylindrical outer surface portions of said upper portions of said first and said second door hangers have a hard coating.

14. An apparatus, according to claim 13, wherein said hard coating is a ceramic coating.

15. An apparatus, according to claim 12, wherein at least one of said first and said second door hangers has at least one lubrication groove formed in said cylindrical outer surface portion thereof and said tube has a lubrication fitting for supplying lubrication to said at least one lubrication groove.

16. An apparatus, according to claim 1, wherein said tube has a hard, polished coating on a bore of said tube.

17. An apparatus, according to claim 16, wherein said hard, polished coating is electroless nickel.

* * * * *